US008001640B2

(12) United States Patent
Carter

(10) Patent No.: US 8,001,640 B2
(45) Date of Patent: Aug. 23, 2011

(54) MIG WELDING PLIERS

(76) Inventor: Rahman Carter, Philadelphia, PA (US)

( * ) Notice: Subject to any disclaimer, the term of this patent is extended or adjusted under 35 U.S.C. 154(b) by 248 days.

(21) Appl. No.: 12/465,610

(22) Filed: May 13, 2009

(65) Prior Publication Data

US 2010/0288085 A1 Nov. 18, 2010

(51) Int. Cl.
*B25B 7/22* (2006.01)

(52) U.S. Cl. ..... 7/132; 81/418

(58) Field of Classification Search ..... 7/125, 132; 81/418–420

See application file for complete search history.

(56) References Cited

U.S. PATENT DOCUMENTS

| | | | | |
|---|---|---|---|---|
| 1,902,913 | A | 3/1933 | Sievern | |
| 3,760,473 | A * | 9/1973 | Studdard | 407/29.1 |
| 3,774,306 | A | 11/1973 | Dobyns | |
| D307,699 | S | 5/1990 | Sugunami | |
| 5,497,522 | A | 3/1996 | Chen | |
| D386,375 | S * | 11/1997 | Harris | D8/52 |
| D449,768 | S * | 10/2001 | Salazar et al. | D8/52 |
| 7,039,973 | B1 | 5/2006 | Lehmann | |
| 7,234,377 | B2 * | 6/2007 | Wolfson | 81/415 |
| 7,676,873 | B1 * | 3/2010 | Simms | 7/129 |
| 2005/0188468 | A1 * | 9/2005 | Crawford | 7/107 |

OTHER PUBLICATIONS

WELPER YS-50 Application Diagram, Radnor Welding Products, PO Box 6675, Radnor, PA 19087.

* cited by examiner

*Primary Examiner* — David B Thomas
(74) *Attorney, Agent, or Firm* — Michael R. Kahn

(57) ABSTRACT

An improved MIG welding pliers is disclosed, which allows faster and easier removal of spatter form a MIG welding nozzle, thereby improving welder productivity. Embodiments of the present invention provide a rounded file on the outer surface of each of the pinchers of the pliers. In one embodiment, each pincher has a different file surface. The rounded file surface provides for improved spatter removal, and eliminates the need for waxes and spatter control products which degrade the contact tip and nozzle, hastening the need for their replacement. Therefore, embodiments of the present invention increase the efficiency of a MIG welding operation, as less time is spent removing spatter from nozzles, and thus, more time is available for welding. Furthermore, by avoiding the use of waxes, costs are reduced since nozzles and contact tips do not need to be replaced as frequently.

17 Claims, 11 Drawing Sheets

MIG WELDING PLIERS

FIELD OF THE INVENTION

The present invention relates generally to hand tools, and more specifically to pliers.

BACKGROUND

MIG (Metal Inert Gas) Welding is an arc welding process in which a continuous and consumable wire electrode and shielding gas are fed through a welding gun. During use, small particles of molten metal, known as "spatter" adhere to the nozzle, which degrades welding performance, and can adversely affect the quality of the welds. Periodically, the welder must stop welding, and clean the nozzle. This time-consuming activity reduces the overall productivity of the welder. It is therefore desirable to have an improved tool for MIG welding to address the aforementioned problems.

SUMMARY OF THE INVENTION

Embodiments of the present invention provide an improvement to MIG welding pliers which allow faster and easier removal of spatter form a MIG welding nozzle, thereby improving welder productivity. Prior art MIG welding pliers (for example, the WELPER YS-50, distributed by RADNOR WELDING PRODUCTS, of Radnor Pa., USA) provide a flat, smooth, outer surface on the pinchers of the pliers. Embodiments of the present invention provide a rounded file on the outer surface of each of the pinchers of the pliers. In one embodiment, each pincher has a different file surface. For example, one pincher may have a double cut, coarse file on its outer surface, and the other pincher may have a single cut, smooth file on its outer surface. The rounded file surface provides for improved spatter removal, and increases the efficiency of MIG welders, as they spend less time removing spatter from their nozzles since a single tool performs both pliers functions, cutting functions, and filing functions. Time is saved since the welder does not have to change to a different hand tool to perform a filing operation for spatter removal.

One embodiment of the present invention provides a pliers comprising:

a first handle and a second handle, the first handle and second handle joined at a pivot point, the first handle and second handle further comprising an interior curved portion;

a spring disposed between the first handle and the second handle;

a first jaw and a second jaw, the first jaw and second jaw comprising a cutting surface, an outer surface, an anvil portion, and an interior curved portion, and wherein the first jaw and second jaw further comprise a rounded file surface on the outer surface of each jaw.

Another embodiment of the present invention provides a pliers wherein the rounded file surface of the first jaw and the second jaw is a double cut file surface.

Another embodiment of the present invention provides a pliers wherein the rounded file surface of the first jaw and the second jaw is a single cut file surface.

Another embodiment of the present invention provides a pliers wherein the rounded file surface on the outer surface of the first jaw is a double cut file surface, and wherein the rounded file surface on the outer surface of the second jaw is a single cut file surface.

Another embodiment of the present invention provides a pliers wherein the rounded file surface of each jaw comprises a first file surface and a second file surface, wherein the first file surface is disposed closer to the pivot point than the second file surface, and wherein the first file surface has a different pattern than the second file surface.

Another embodiment of the present invention provides a pliers wherein the first file surface is coarser than the second file surface.

Another embodiment of the present invention provides a pliers wherein the first file surface has a teeth-per-inch count ranging from 8 to 12, and wherein the second file surface has a teeth-per-inch count ranging from 14 to 18.

Another embodiment of the present invention provides a pliers wherein the first file surface is a single cut file surface, and wherein the second file surface is a double cut file surface.

Another embodiment of the present invention provides a pliers which further comprises a file surface on the anvil portion.

Another embodiment of the present invention provides a pliers wherein the file surface on the anvil portion and the file surface on the outer surface of each jaw is a single cut file surface.

Another embodiment of the present invention provides a pliers wherein the file surface on the anvil portion and the file surface on the outer surface of each jaw is a double cut file surface.

Another embodiment of the present invention provides a pliers wherein the rounded file surface of each jaw comprises a first file surface and a second file surface, wherein the first file surface is disposed closer to the pivot point than the second file surface and wherein the first file surface is also applied to the surface of the anvil portion, and wherein the first file surface has a different pattern than the second file surface.

Another embodiment of the present invention provides a pliers wherein the first file surface is coarser than the second file surface.

Another embodiment of the present invention provides a pliers wherein the first file surface has a teeth-per-inch count ranging from 8 to 12, and wherein the second file surface has a teeth-per-inch count ranging from 14 to 18.

Another embodiment of the present invention provides a pliers wherein the first file surface is a single cut file surface, and wherein the second file surface is a double cut file surface.

Another embodiment of the present invention provides a pliers wherein the first file surface is a double cut file surface, and wherein the second file surface is a single cut file surface.

Another embodiment of the present invention provides a pliers wherein the first file surface is a single cut file surface, and wherein the second file surface is also a single cut file surface.

DETAILED DESCRIPTION

Figure 1A:
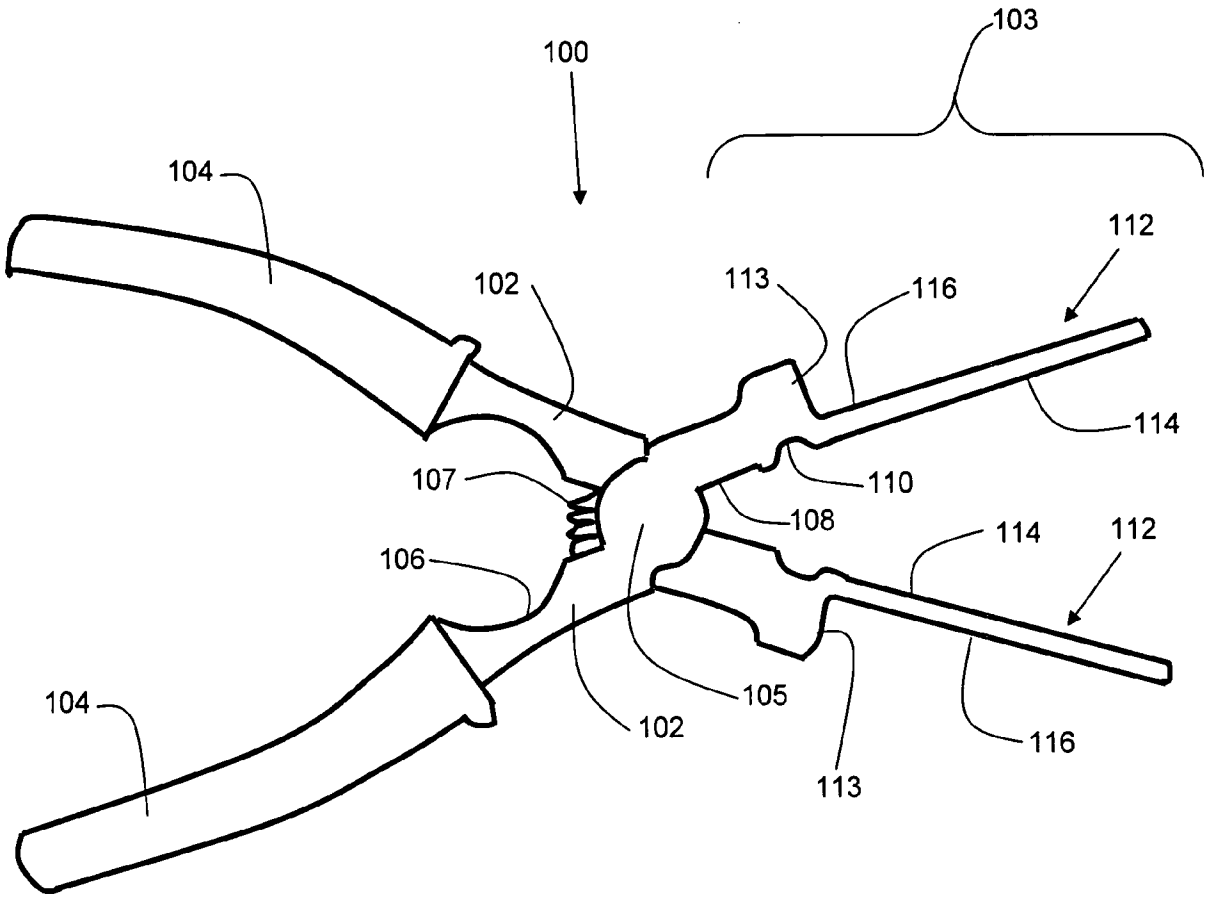
FIG. 1A Prior Art
FIG. 1A shows a prior art pliers tool.

For the purpose of providing context, the prior art will be briefly discussed. FIG. 1A shows a prior art MIG pliers 100. Pliers 100 comprises two handles 102, each having a gripping surface 104. The handles 102 are joined at pivot point 105 as is known in the art, and is often formed by a rivet (not shown). A spring 107 is disposed between the two handles 102 to provide convenient opening and closing of the pliers. Each handle 102 has a large interior curved portion 106, which is useful for nozzle removal and installation. The portion of the pliers to the right of pivot 102 in FIG. 1 is referred to generally as the head section 103.

Head section 103 comprises two jaws 112. Each jaw 112 comprises a cutting surface 108, which is useful for wire cutting, a small interior curved portion 110, suited for removing and installing contact tips. Anvil portion 113 is smooth, and is used for removing spatter from the nozzle end. Each jaw 112 has an inner surface 114 and an outer surface 116. The outer surface 116 is essentially flat and smooth. Typically, a single piece of metal comprises both a handle and a jaw, hence two pieces, joined at pivot 105, form the pliers mechanism.

Figure 1B:
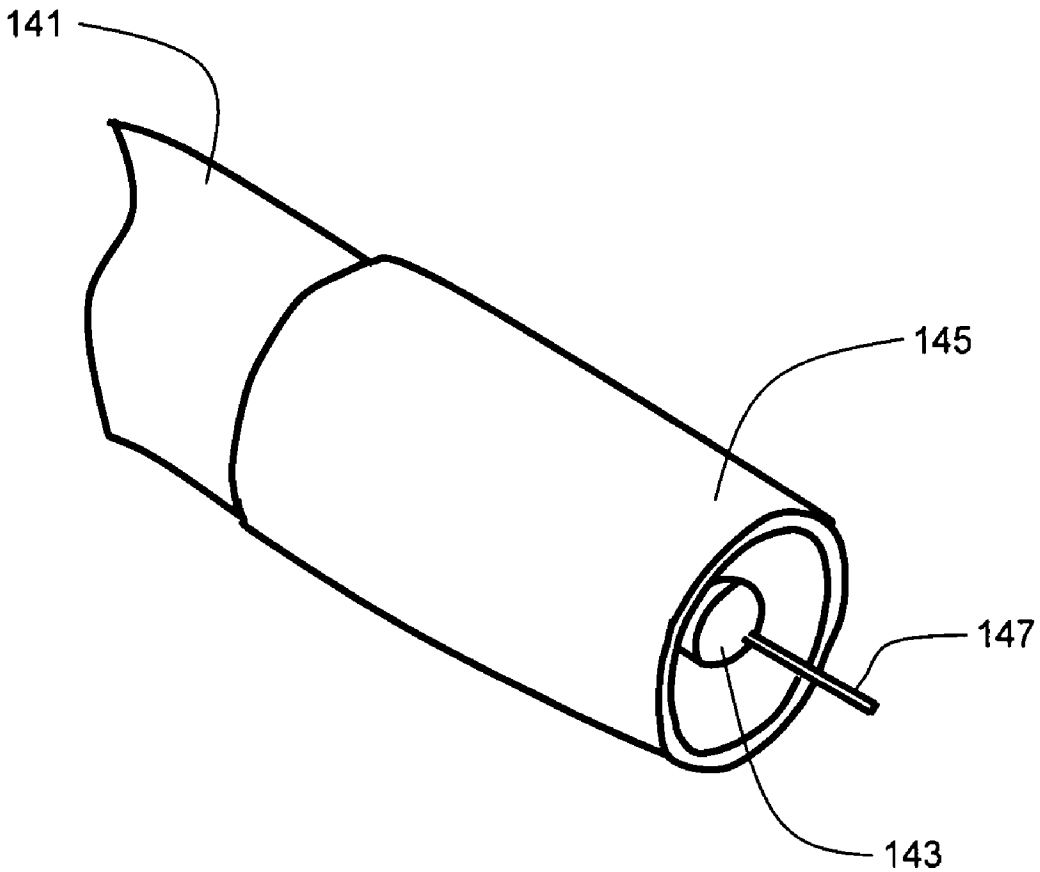
FIG. 1B Prior Art
FIG. 1B shows a MIG welding nozzle.

FIG. 1B shows details of a MIG welding apparatus as is known in the art. A portion of handle 141 is shown. Attached to handle is the nozzle 145. Inside nozzle 145 is contact tip 143, and consumable wire 147. During operation of the MIG welding apparatus, molten bits of metal, referred to as "spatter" adhere to the interior of nozzle 145. This spatter disturbs the flow of gas through the nozzle, and hence, can impact the performance of the welding apparatus and quality of the welds. It is therefore important to remove the spatter periodically. While the prior art device described above is a useful accessory for a MIG welder, it is not optimal for removal of spatter buildup from the interior of the nozzle 145. Embodiments of the present invention provide for a MIG pliers having improved capability for removal of spatter buildup from the interior of a MIG welding gun nozzle. These embodiments are described in the following detailed description.

Figure 2:
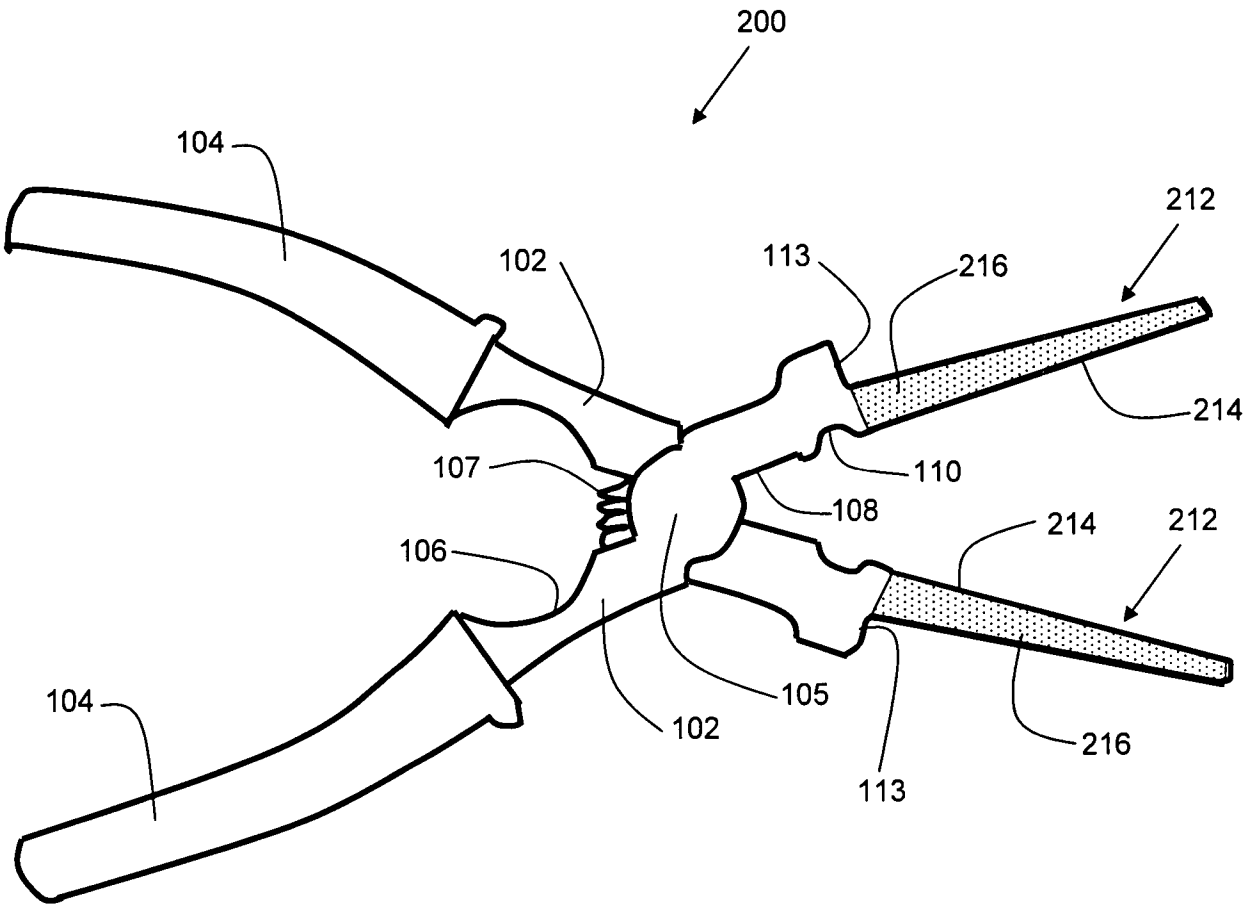
FIG. 2 shows an embodiment of a pliers tool in accordance with the present invention.

FIG. 2 shows an embodiment of a MIG pliers 200 in accordance with the present invention. Pliers 200 differs from pliers 100 in that jaws 212 comprise an outer surface comprised of a rounded file surface 216. The inner surface 214 of jaws 212 is similar to inner surface 114 of pliers 100. File surface 216 is a double cut file surface. A bastard cut, second cut, or smooth cut may be used for file surface 216.

Figure 3:
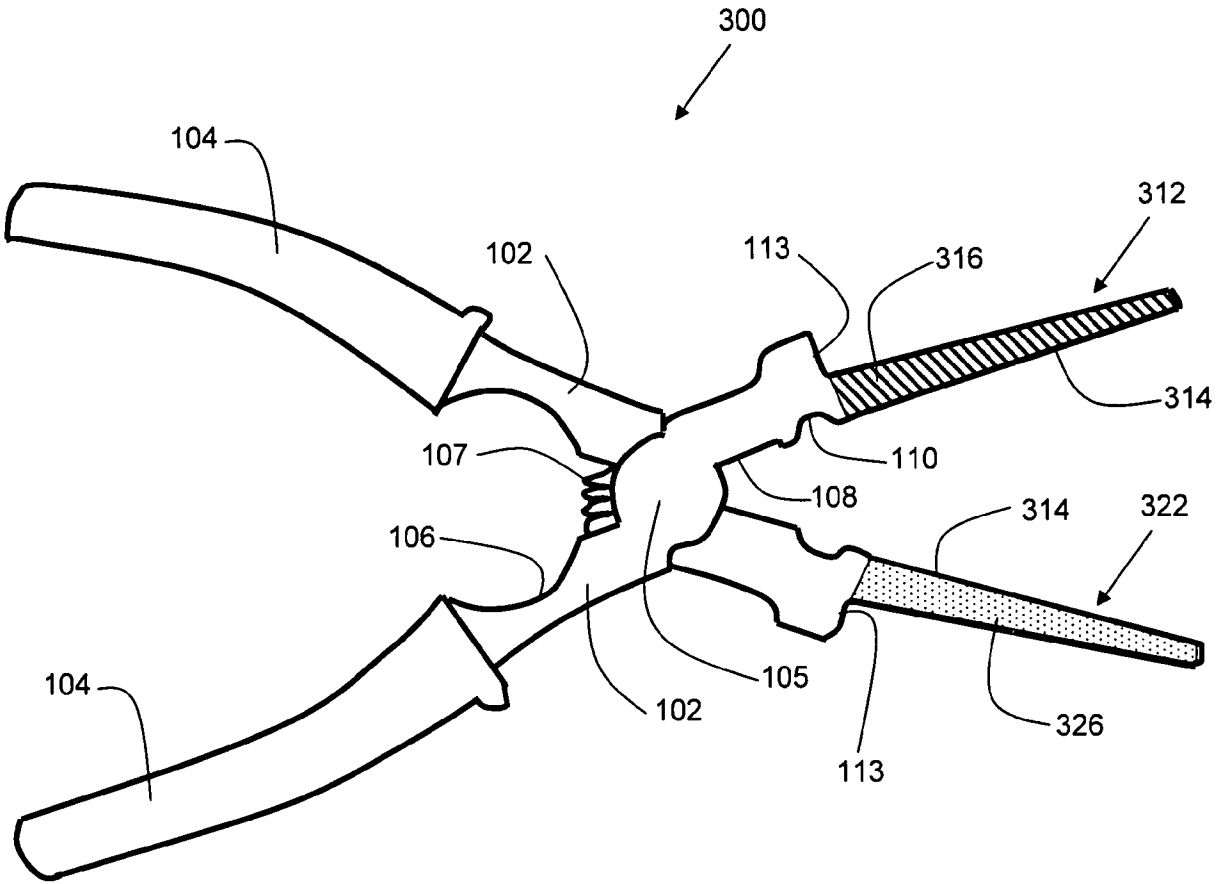
FIG. 3 shows an alternative embodiment of a pliers tool in accordance with the present invention.

FIG. 3 shows an alternative embodiment of a MIG pliers 300. In this embodiment, jaw 312 is comprised of a single cut, coarse file surface 316, and jaw 322 is comprised of a smoother double cut file surface 326. The inner surface 314 is similar to inner surface 114 of pliers 100.

Figure 4:
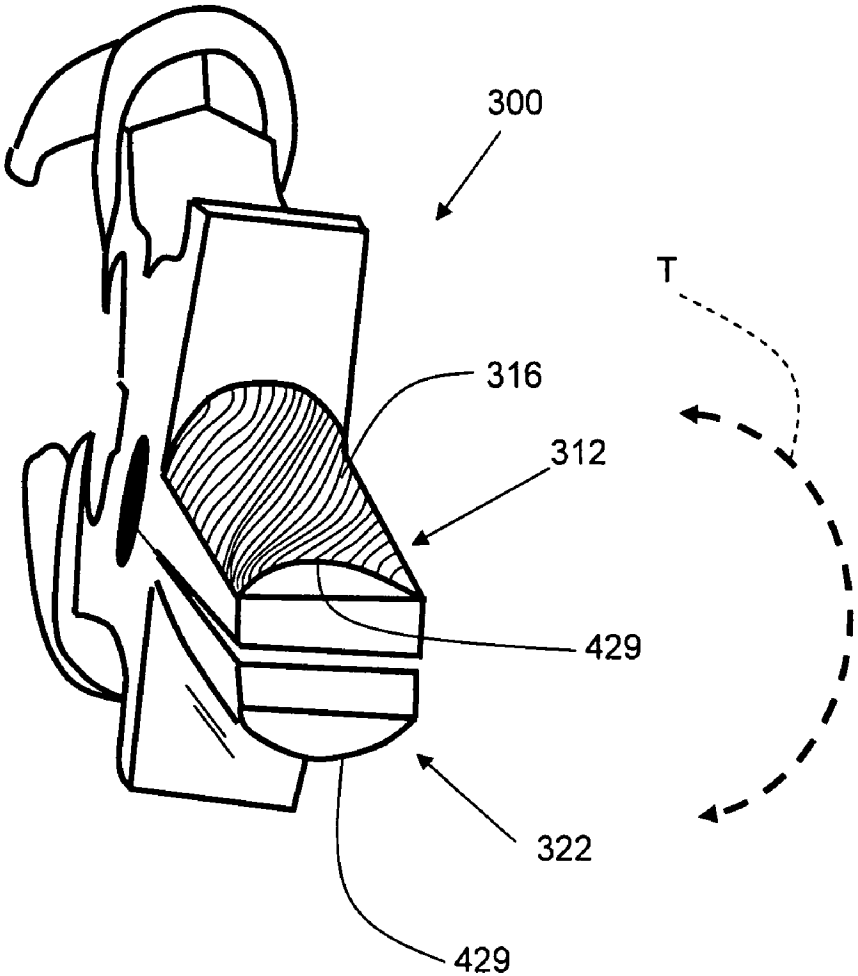
FIG. 4 shows a front perspective view of the embodiment of FIG. 3.

FIG. 4 shows a front perspective view of the MIG pliers 300 shown in FIG. 3. In this view, the curved form factor 429 of single cut file surface 316 is visible. In one embodiment, file surface 316 has a "half-round" curved form factor. When using MIG pliers 300 for spatter removal, the pliers 300 is turned in a circular manner, indicated by arrow T.

Figure 5:
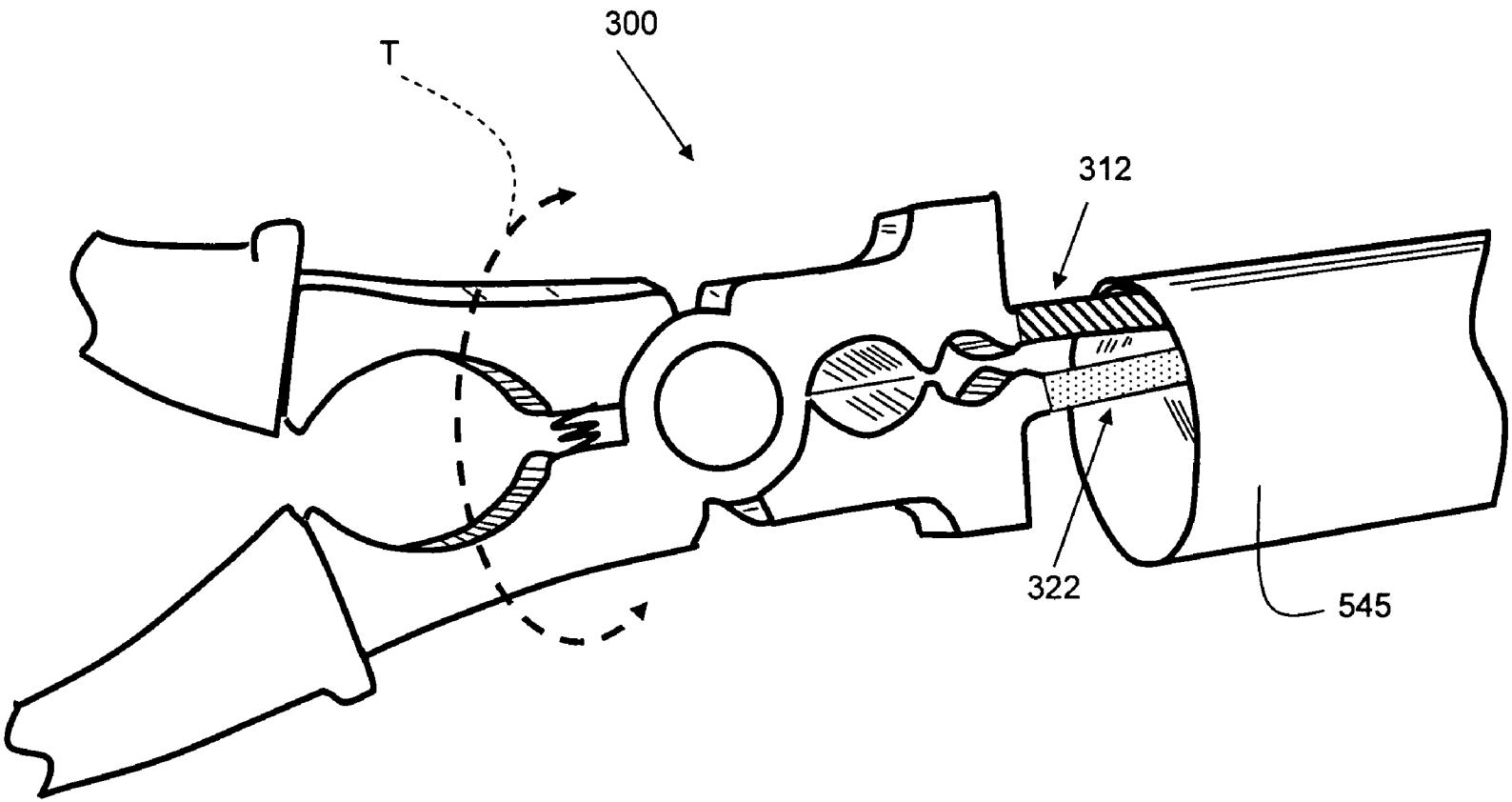
FIG. 5 shows an embodiment of the present invention in use.

FIG. 5 shows an embodiment of the present invention in use. In order to remove spatter from the interior of nozzle 545, the pliers 300 is turned briskly in each direction along the path indicated by arrow T. The jaws 312 and 322 are positioned inside nozzle 545. In one manner of usage, jaw 312, having a coarser surface, is used first, which removes large pieces of spatter. Then, the pliers are positioned such that jaw 322 is in contact with the interior of nozzle 545. The finer file surface on jaw 322 removes smaller particles of spatter.

Figure 6:
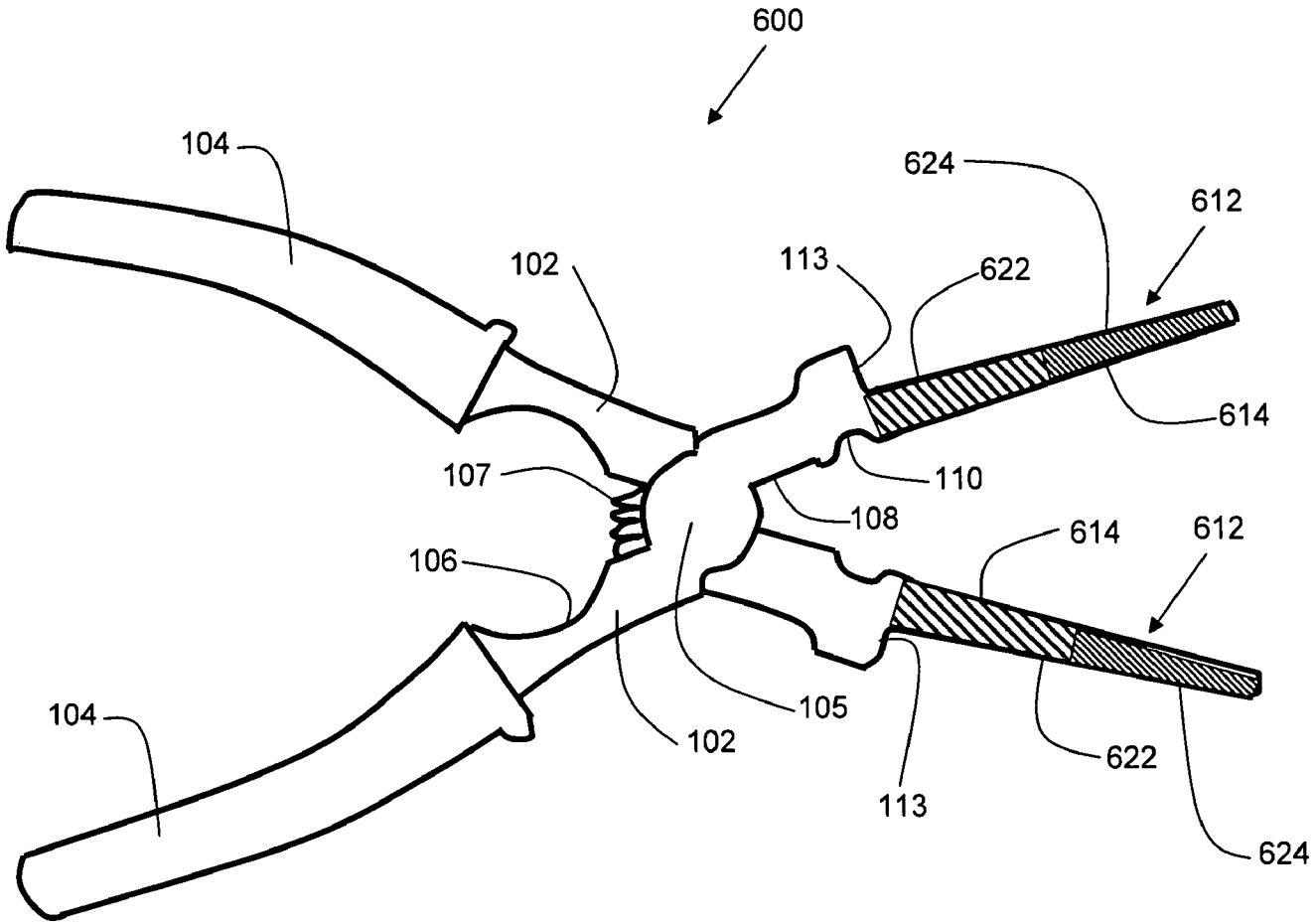
FIG. 6 shows another alternative embodiment of a pliers tool in accordance with the present invention.

FIG. 6 shows an additional alternative embodiment of a MIG pliers 600. In this embodiment, each jaw 612 is comprised of a composite file surface, comprising a coarse file surface 622, and a smooth file surface 624. For example, in one embodiment, surface 622 is a "bastard cut" file surface, and surface 624 is a second cut file surface. In another embodiment, surface 624 is a smooth cut file surface. The terms "bastard cut," "second cut," and smooth cut are terms pertaining to American Pattern Coarseness, used as a description of file coarseness, and is correlated to the TPI (teeth per inch) count of a file surface.

In one embodiment, surface 622 and surface 624 are single cut file surfaces, and surface 624 has a greater TPI (teeth per inch) count than surface 622. In one embodiment, file surface 622 has a TPI count in the range of about 8 to 12, and file surface 624 has a TPI count in the range of about 14-18. The inner surface 614 is similar to inner surface 114 of pliers 100. It is also possible to have an embodiment with one or more of surfaces 622 and 624 having a double cut file surface. The inner surface 614 is similar to inner surface 114 of pliers 100.

Figure 7:
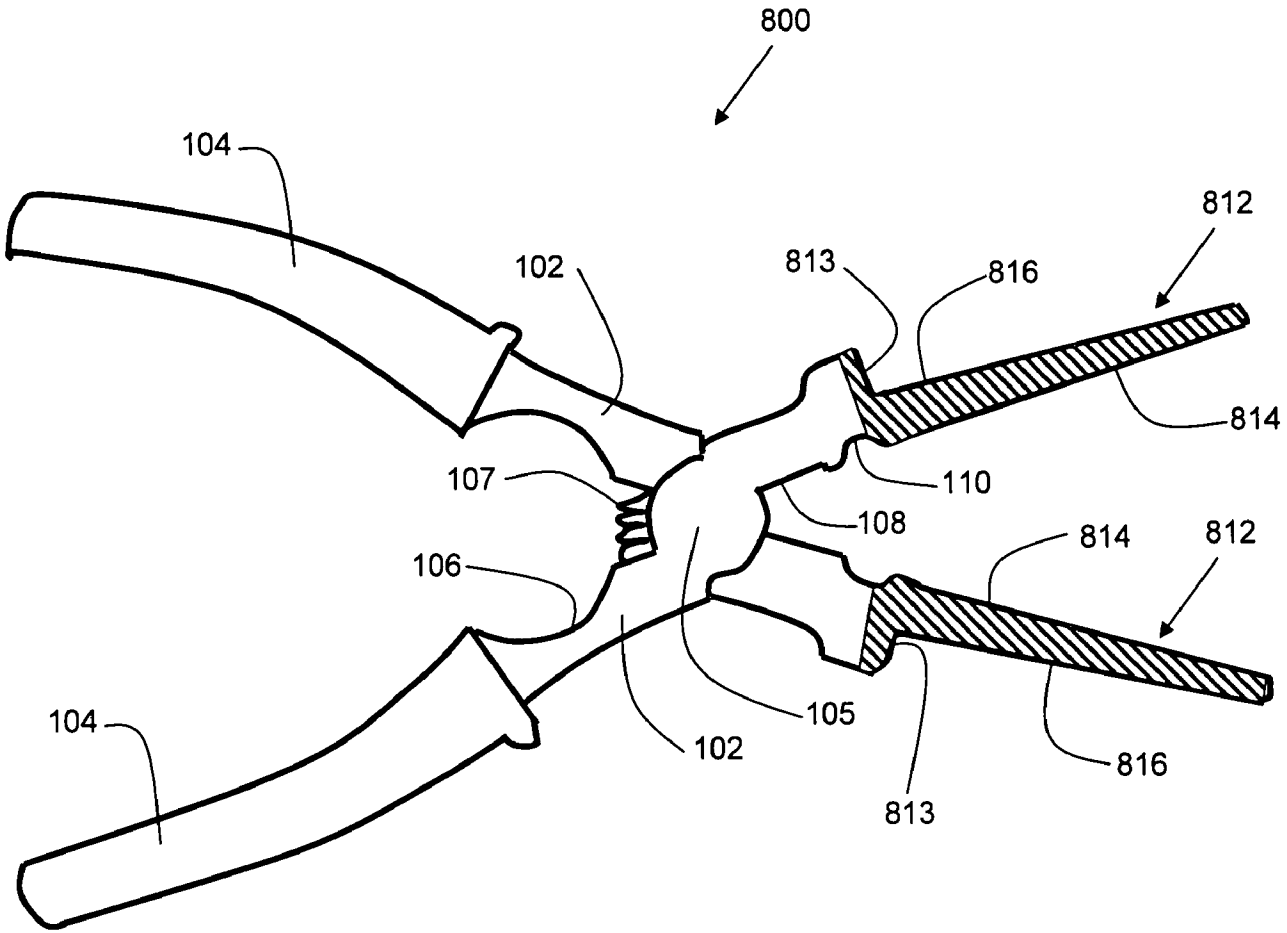
FIG. 7 shows another alternative embodiment of a pliers tool in accordance with the present invention.

FIG. 7 shows another alternative embodiment of a MIG pliers 800. In this embodiment, each jaw 812 is comprised of a file surface 816 that is also extended onto anvil portion 813. The inner surface 814 is similar to inner surface 114 of pliers 100.

Figure 8:
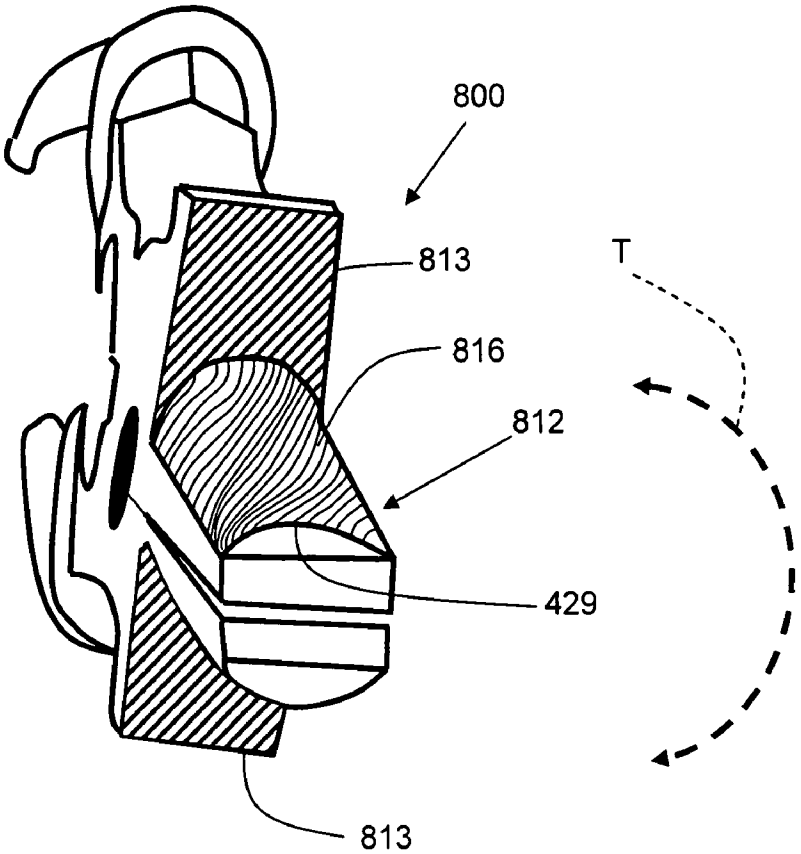
FIG. 8 shows a front perspective view of the embodiment of FIG. 7.

FIG. 8 shows a front perspective view of MIG pliers 800. In this view, the filed surface of anvil 813 is visible. The filed surface of anvil 813 provided for improved spatter removable capability from the outer rim of a nozzle. When using MIG pliers 800 for spatter removal, the pliers 800 is turned in a circular manner, indicated by arrow T.

Figure 9:
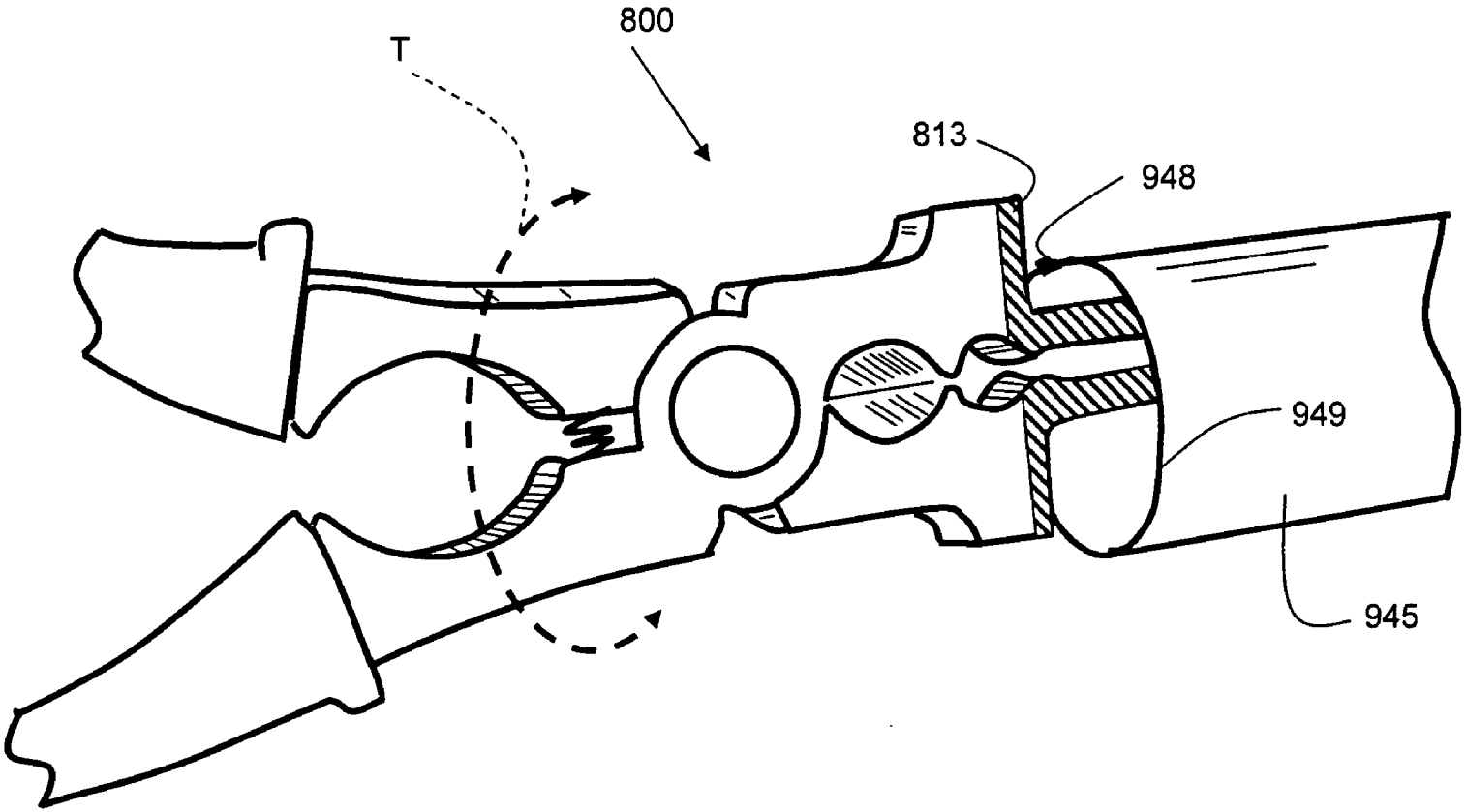
FIG. 9 shows the embodiment of FIG. 7 in use.

FIG. 9 shows the embodiment of MIG pliers 800 in use. Nozzle 945 has spatter 948 disposed on the outer rim 949 of nozzle 945. To remove spatter from the outer rim, the MIG pliers 800 is inserted into nozzle 945 such that anvil 813 makes contact with outer rim 949, and the pliers 800 is then turned briskly in each direction along the path indicated by arrow T.

Figure 10:
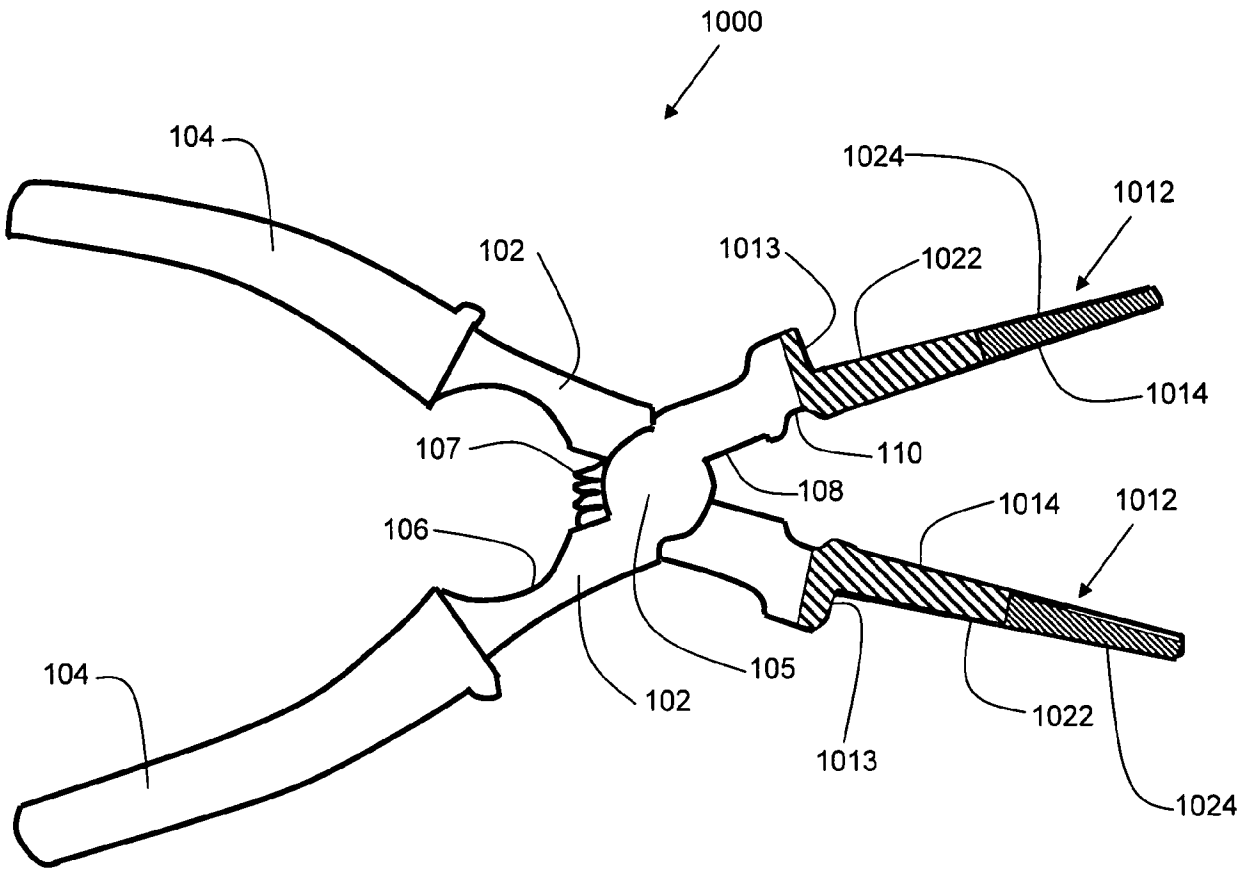
FIG. 10 shows another alternative embodiment of a pliers tool in accordance with the present invention.

FIG. 10 shows another alternative embodiment of a pliers tool in accordance with the present invention. In this embodiment, each jaw 1012 is comprised of a composite file surface, comprising a coarse file surface 1022, and a smooth file surface 1024, similar to that shown in the embodiment of MIG pliers 600. However, unlike MIG pliers 600, with MIG pliers 1000, file surface 1022 extends to anvil 1013, which provides the improved spatter removal from the outer rim of a nozzle as shown and described in FIG. 9, and also provides the advantages of the composite file surface.

Embodiments of the present invention provide an improved MIG welding pliers tool. These embodiments allows a welder to quickly and conveniently remove spatter that accumulates on a nozzle during the MIG welding process, and thus allows a team of welders to be more productive, as less time on the job is spent on spatter removal, leaving more time for performing welding.

Although the description above contains many specific details, these should not be construed as limiting the scope of the invention, but merely as providing illustrations of some of the presently preferred embodiments of the present invention. The present invention may have various other embodiments. Furthermore, while the form of the invention herein shown and described constitutes a preferred embodiment of the invention, it is not intended to illustrate all possible forms thereof. It will also be understood that the words used are words of description rather than limitation, and that various changes may be made without departing from the spirit and scope of the invention disclosed. Thus, the scope of the invention should be determined by the appended claims and their legal equivalents, rather than solely by the examples given.

What is claimed is:

1. A pliers comprising:

a first handle and a second handle, the first handle and second handle joined at a pivot point, the first handle and second handle further comprising an interior curved portion;

a spring disposed between the first handle and the second handle;

a first jaw and a second jaw, the first jaw and second jaw comprising a cutting surface, an outer surface, an anvil portion, and an interior curved portion, and wherein the first jaw and second jaw further comprise a rounded file surface on the outer surface of each jaw; and wherein the rounded file surface on the outer surface of the first jaw is a double cut file surface, and wherein the rounded file surface on the outer surface of the second jaw is a single cut file surface.

2. The pliers of claim 1, wherein the rounded file surface of each jaw comprises a first file surface and a second file surface, wherein the first file surface is disposed closer to the pivot point than the second file surface, and wherein the first file surface has a different pattern than the second file surface.

3. The pliers of claim 2, wherein the first file surface is coarser than the second file surface.

4. The pliers of claim 3, wherein the first file surface has a teeth-per-inch count ranging from 8 to 12, and wherein the second file surface has a teeth-per-inch count ranging from 14 to 18.

5. The pliers of claim 3, wherein the first file surface is a single cut file surface, and wherein the second file surface is a double cut file surface.

6. The pliers of claim 1, further comprising a file surface on the anvil portion.

7. The pliers of claim 6, wherein the file surface on the anvil portion and the file surface on the outer surface of each jaw is a single cut file surface.

8. The pliers of claim 6, wherein the file surface on the anvil portion and the file surface on the outer surface of each jaw is a double cut file surface.

9. The pliers of claim 6, wherein the rounded file surface of each jaw comprises a first file surface and a second file surface, wherein the first file surface is disposed closer to the pivot point than the second file surface and wherein the first file surface is also applied to the surface of the anvil portion, and wherein the first file surface has a different pattern than the second file surface.

10. The pliers of claim 9, wherein the first file surface is coarser than the second file surface.

11. The pliers of claim 10, wherein the first file surface has a teeth-per-inch count ranging from 8 to 12, and wherein the second file surface has a teeth-per-inch count ranging from 14 to 18.

12. The pliers of claim 10, wherein the first file surface is a single cut file surface, and wherein the second file surface is a double cut file surface.

13. A pliers comprising:

A first handle and a second handle, the first handle and second handle joined at a pivot point, the first handle and second handle further comprising an interior curved portion;

a first jaw and a second jaw, the first jaw and second jaw comprising a cutting surface, an outer surface, an anvil portion, and an interior curved portion, and wherein the first jaw and second jaw further comprise a rounded file surface on the outer surface of each jaw and wherein each rounded file surface comprises a first file surface and a second file surface, and wherein the first file surface is disposed closer to the pivot point than the second file surface and wherein the first file surface is coarser than the second file surface.

14. The pliers of claim 13, wherein the first file surface is a single cut file surface, and wherein the second file surface is a double cut file surface.

15. The pliers of claim 13, wherein the first file surface is a double cut file surface, and wherein the second file surface is a single cut file surface.

16. The pliers of claim 13, wherein the first file surface is a single cut file surface, and wherein the second file surface is also a single cut file surface.

17. The pliers of claim 16, wherein the first file surface has a teeth-per-inch count ranging from 8 to 12, and wherein the second file surface has a teeth-per-inch count ranging from 14 to 18.

* * * * *